US007298233B2

(12) United States Patent
Zimmerman

(10) Patent No.: US 7,298,233 B2
(45) Date of Patent: Nov. 20, 2007

(54) PANEL ANTENNA WITH VARIABLE PHASE SHIFTER

(75) Inventor: Martin Zimmerman, Chicago, IL (US)

(73) Assignee: Andrew Corporation, Westchester, IL (US)

( * ) Notice: Subject to any disclaimer, the term of this patent is extended or adjusted under 35 U.S.C. 154(b) by 351 days.

(21) Appl. No.: 10/711,919

(22) Filed: Oct. 13, 2004

(65) Prior Publication Data

US 2006/0077098 A1 Apr. 13, 2006

(51) Int. Cl.
*H01P 1/18* (2006.01)
*H01Q 3/00* (2006.01)
*H01Q 9/28* (2006.01)

(52) U.S. Cl. ..... 333/161; 342/372; 343/795

(58) Field of Classification Search ..... 342/372; 333/161, 156, 118, 117, 159; 343/757, 853, 343/797, 795

See application file for complete search history.

(56) References Cited

U.S. PATENT DOCUMENTS

| | | | | |
|---|---|---|---|---|
| 2,939,335 | A * | 6/1960 | Braund et al. | 74/507 |
| 3,205,419 | A * | 9/1965 | Voigt | 318/674 |
| 4,241,352 | A | 12/1980 | Alspaugh et al. | |
| 5,917,455 | A * | 6/1999 | Huynh et al. | 343/792.5 |
| 6,377,134 | B1 * | 4/2002 | Takenaka | 333/161 |
| 6,573,875 | B2 * | 6/2003 | Zimmerman et al. | 343/853 |
| 6,621,377 | B2 | 9/2003 | Osadchy et al. | |
| 6,646,522 | B1 | 11/2003 | Kozyrev et al. | |
| 6,667,714 | B1 | 12/2003 | Solondz | |
| 6,756,939 | B2 | 6/2004 | Chen et al. | |
| 6,850,130 | B1 * | 2/2005 | Gottl et al. | 333/161 |
| 6,987,487 | B2 * | 1/2006 | Zimmerman et al. | 343/757 |
| 2002/0075145 | A1 * | 6/2002 | Hardman et al. | 340/442 |
| 2002/0126059 | A1 * | 9/2002 | Zimmerman et al. | 343/757 |
| 2002/0135524 | A1 * | 9/2002 | Zimmerman et al. | 343/760 |
| 2003/0076198 | A1 * | 4/2003 | Phillips et al. | 333/161 |

(Continued)

FOREIGN PATENT DOCUMENTS

| | | |
|---|---|---|
| JP | 05121915 | 5/1993 |

(Continued)

OTHER PUBLICATIONS

G. E. Bacon, Variable-Elevation Beam-Aerial Systems for 1.5 Meters, Journal IEE, Part IIIA, vol. 93, USA Apr. 1946.

*Primary Examiner*—Thomas H. Tarcza
*Assistant Examiner*—Hien Ly
(74) *Attorney, Agent, or Firm*—Babcock IP, PLLC

(57) ABSTRACT

A panel antenna having a variable phase shifter module with at least one main-PCB having an input trace coupled to a wiper junction. An arcuate trace on the main-PCB extending between a first output trace and a second output trace, the arcuate trace having an arc center proximate the wiper junction. A wiper-PCB having a linking trace thereon; the wiper-PCB rotatably coupled to the main-PCB proximate the wiper junction with the linking trace facing the first main-PCB. Because the linking trace faces the main-PCB, the wiper-PCB may be formed from inexpensive and structurally resilient substrate material. The linking trace coupling the wiper junction with the arcuate trace. Multiple arcuate traces may be linked to further output traces to add additional outputs, each having variable phase shift between them, depending upon the position of the wiper-PCB. Multiple main-PCBs may be stacked upon each other and the wiper-PCBs of each controlled by a common linkage.

21 Claims, 11 Drawing Sheets

U.S. PATENT DOCUMENTS

2003/0137294 A1* 7/2003 Gleixner et al. ..... 324/207.17
2004/0061653 A1 4/2004 Webb et al.
2004/0090286 A1 5/2004 Runyon
2004/0217908 A1* 11/2004 Zigler et al. ..... 343/757
2005/0017822 A1* 1/2005 Runyon ..... 333/117
2005/0046514 A1* 3/2005 Janoschka ..... 333/156
2005/0179610 A1* 8/2005 Le et al. ..... 343/797
2005/0219133 A1* 10/2005 Elliot ..... 343/757
2006/0145784 A1* 7/2006 Dean ..... 333/161
2006/0164185 A1* 7/2006 Tae et al. ..... 333/161
2006/0273864 A1* 12/2006 Zimmerman et al. ..... 333/161

FOREIGN PATENT DOCUMENTS

JP 06326501 11/1994

* cited by examiner

PANEL ANTENNA WITH VARIABLE PHASE SHIFTER

BACKGROUND

1. Field of the Invention

This invention relates to a cellular base station communication system and more particularly to a panel antenna having a compact stackable variable phase shifter.

2. Description of Related Art

Differential variable phase shifters introduce a desired phase shift between RF energy split between two or more outputs. Differential variable phase shifters are useful, for example, as components in the electrically variable beam elevation and or azimuth scan angle antenna systems of cellular communications base stations. The desired phase shift is typically obtained by modifying the electrical path required to reach each output with respect to the other output(s). To adjust the electrical path in one common design approach, a transmission line conductive arc has an associated wiper, pivoted at the center of the arc, which is moved along the surface of the arc, apportioning the length of an electrical path from the wiper input to either end of the conductive arc depending upon the position of the wiper along the conductive arc.

The wiper has a conductive component to transmit the input signal to the conductive arc. In typical prior art differential phase shifters of the capacitive pivoted wiper type, a non-conductive dielectric element is used between the conductive arc and wiper conductive component to reduce inter-modulation distortion (IMD).

As will be described below, the wiper may be an arm composed of metal; in that approach the arm comprises the wiper conductive component. The dielectric element in the metal wiper design arrangement is typically a dielectric shim, for example.

Or the wiper alternatively may comprise, e.g., a microwave quality dielectric material having a conductive trace on its surface facing away from the conductive arc and groundplane behind the arc. If the spacing between the wiper conductive element and the conductive arc varies significantly as the wiper is pivoted along the conductive arc, the capacitive coupling between the two conductors will vary, causing undesired variations in both reflected and transmitted energy.

The spacing variations may be caused, for example, by the wiper being coupled too loosely to the conductive arc. On the other hand, if the wiper is pressed too firmly against the trace, the wiper may bind or require excessive force to move.

In addition, some method of transferring motion to the wiper from a point external to the phase shifter is needed to allow remote adjustment of the wiper location along the conductive arc. The remote adjustment linkage device is preferably non-conductive in nature so as to avoid distorting the EM fields in the phase shifter and to avoid generating IMD.

In the current art these various functions of providing mechanical wiper support and remote position adjustment are accomplished with multiple parts which undesirably increase the size, cost, complexity, and reliability of the overall structure. In one embodiment alluded to above, the conductive arc and wiper are formed of cast, stamped or formed metal. Non-conductive spacing shims or sheets are used to improve IMD performance. Additional non-conductive plastic parts are typically added to connect the wiper to the remote adjustment linkage device. Additional non-conductive fasteners and/or spacers are typically used to support the arc and metal wiper and to hold them in close contact.

In another embodiment mentioned above the wiper body is a substrate composed not of metal, but rather of a dielectric material, and the wiper conductive component is formed as a conductive trace upon a dielectric substrate. The trace is located on the substrate surface facing away from the arcuate conductor. Because the wiper conductive component comprises part of the transmission line to the radiating elements, in this prior art approach the dielectric wiper body must be composed of a microwave-quality dielectric substrate such as PTFE or PTFE-ceramic glass fiber laminates. Such microwave-quality substrates are electrically distinct from standard printed circuit board (PCB) substrates such as epoxy-glass in two ways. They exhibit much lower insertion loss at RF frequencies and they exhibit much tighter tolerance in their dielectric constant. Depending upon the electrical characteristics and uniformity required, microwave-quality substrates may cost between 3 to 100 times more per square foot than standard printed circuit board substrates.

Using a PCB substrate for the wiper element has a number of advantages. The first is that the dielectric substrate can be used as the non-conductive layer between the arc conductor and wiper conductor. The second is that the wiper substrate, being non-conductive, can be extended beyond the phase shifter to act as a lever arm for connecting the wiper element to a phase shifter adjustment linkage external to the phase shifter.

However, if the dielectric substrate is located between the arc conductor and the wiper conductor, then it must be of microwave quality. This causes several problems. One is that extending the wiper substrate to attach to the linkage is not economically desirable due to high cost of the material relative to other plastics. Secondly, most microwave-quality substrates lack the structural stiffness required for use as a mechanical support member. Therefore, most implementations that utilize microwave-quality substrates add additional mechanical elements, such as bars or springs in order to maintain the proper spacing between the arc conductor and wiper conductor and to provide the necessary structural support for the wiper.

"Antenna System", U.S. Pat. No. 6,573,875 issued Jun. 3, 2003 to Zimmerman et al, hereby incorporated by reference in the entirety, describes a phase shifter implementation upon the back plane of a cellular base station radiator array antenna using microwave quality substrates for the wiper as described herein above. To adjust the phase between five radiator clusters of the antenna, two separate phase shifter modules with a common adjustment linkage are applied. Each five output phase shifter module is adapted for minimum front-to-back thickness (height) to allow the host antenna to have a minimum height profile for reduced wind loading and improved visual impact.

Reductions in wind loading allow an overall reduction in the structural requirements of the antenna system as well as those of the mounting hardware and support structure, thereby reducing overall costs. Visual impact is an important consideration due to growing public resistance to the addition of obtrusive antenna structures to existing buildings and or installation of new antenna towers on esthetic grounds.

Resulting antenna thickness prevents desired use of a single centrally located stacked phase shifter assembly. To achieve the desired minimum thickness or height of the overall antenna, individual phase shifter modules with five outputs each are placed end to end and linked together by a common mechanical linkage adapted to be as thin as possible. As a result, the phase shifters take up a significant portion of the antenna backplane surface area. Cabling from the phase shifter outputs to each of the desired radiator clusters is manufactured with identical lengths of coaxial cable for manufacturing and design simplification whereby further phase adjustments do not occur after the phase shifter(s) because the final connection to each radiator has an identical length, i.e. the length of the longest path. However, because the phase shifter(s) are covering a large portion of the antenna back plane, the longest path from each phase shifter module is significantly increased. Also, because the mechanical linkage must extend to each wiper arm, the mechanical linkage includes a plurality of individual components such as link arms and fasteners.

Other antenna systems incorporating phase shifters have stacked phase shifter printed circuit boards upon each other and combined arc traces with a common wiper arm to reduce linkage complexity and the longest length of the interconnecting radiator cables. However, the stacked configurations significantly increase the overall thickness or height of the resulting antenna and enclosing radome.

Another prior configuration applies a stacked wiper configuration positioned on the radiator side of the backplane. This configuration may reduce the overall thickness or height of the antenna but may cause anomalies in the antenna radiation pattern(s) as well as increases in linkage complexity and or the total number of required manufacturing operations.

Competition within the antenna system and phase shifter markets has focused attention also on improved electrical performance, reliability, ease of use and materials and manufacturing operations costs.

Therefore, it is an object of the invention to provide an apparatus that overcomes or ameliorates the described deficiencies in the prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

The present invention addresses and resolves a multitude of the shortcomings of panel antennas for use in cellular communication systems and particularly those employing differential-type capacitive wiper phase shifter technology. As will be explained at length below, by making a number of changes in prior art approaches, radical improvements in cost and compactness of the phase shifter system and in the embodying panel antenna are achieved.

Among the structural improvements leading to a variety of benefits and features is the use of a low cost dielectric substrate for the wiper and the use of conductive trace on the side of the wiper substrate facing the conductive arc and backplane. By this simple but completely previously overlooked inversion of the wiper substrate, the wiper body no longer must be composed of microwave quality material which is extremely expensive and structurally very weak. Rather, the wiper body according to the invention is preferably composed of PCB material which is such a strong and stable structural material that the previously required supplementary supporting structures required to support the dielectric material and couple the wiper to a remote phase shifter adjustment linkage can be completely eliminated.

The present design in its preferred implementations with integrated unitary linkage coupling are so compact in thickness (height above the backplane) that a number of phase shifters can be stacked in a ground-hugging profile. The ability to compactly stack the phase shifters without creating a visually offensive and wind-loading high radome makes the resulting antenna more compatible with municipal environmental demands and significantly reduces the bracketry and mechanical windloading supports for the antenna.

The ability to create a low profile stack of phase shifters according to the present invention means that a single phase shifter assembly can be positioned centrally on the panel, greatly reducing the cabling required from the phase shifter system to the radiating elements. Additional cost savings result from the reducing the number of phase shifter assemblies that must by mounted and coupled to remote adjustment linkages.

Details of the structures and techniques by which the objectives of the present invention may be realized are described in detail herein below.

Figure 1:
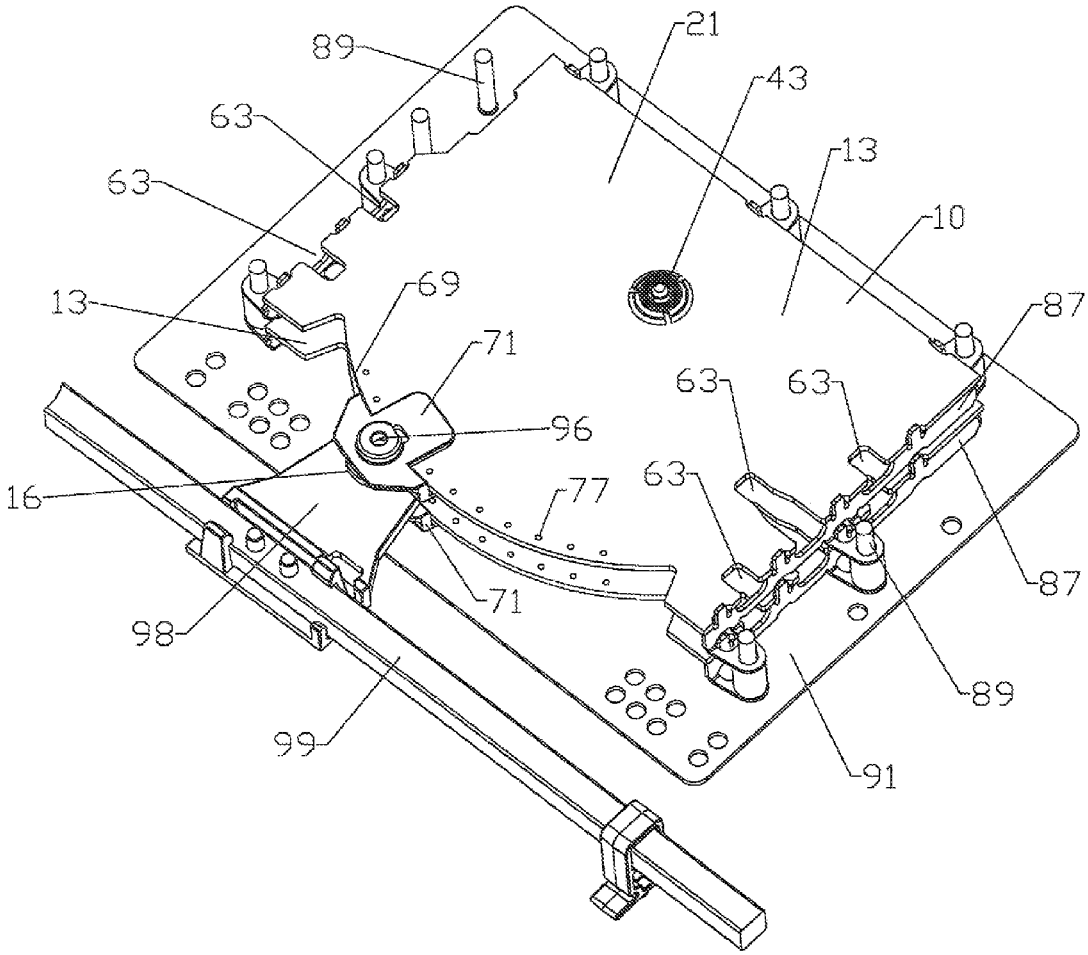
FIG. 1 is an isometric schematic top view of a phase shifter module, with an adjustment linkage attached, according to a first embodiment of the invention.

As shown in FIG. 1, a phase shifter module 10 according to a first embodiment of the invention has a significantly reduced mounting area requirement that enables central positioning of the phase shifter upon the rear surface of an antenna backplane, thereby minimizing the longest required length of the signal cable(s) interconnecting the antenna radiator clusters with their respective phase shifter outputs.

Figure 2A:
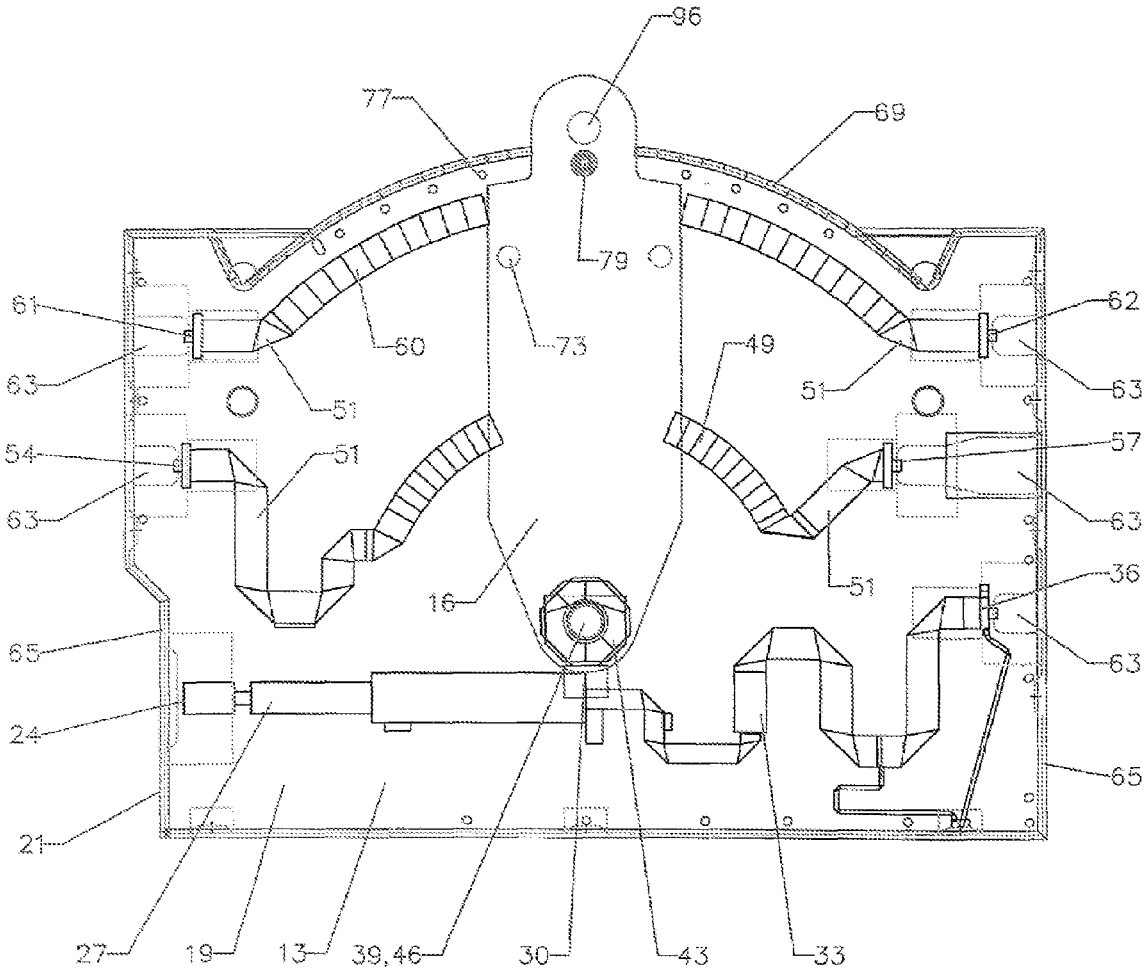
FIG. 2*a* is a schematic top view of a printed circuit board (PCB) for the phase shifter module of FIG. 1.
Figure 2B:
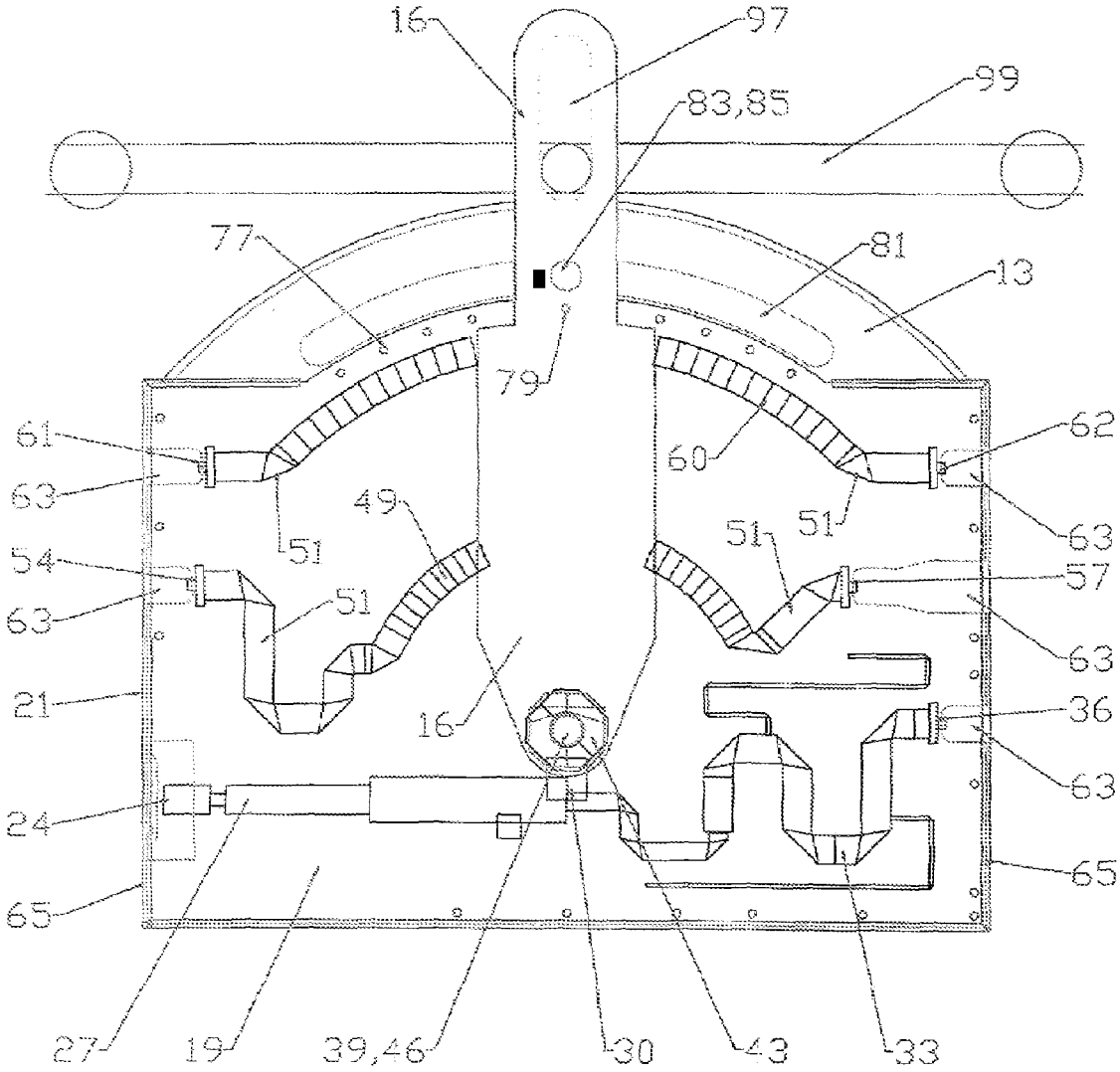
FIG. 2*b* is a schematic top view of a PCB for an alternative embodiment of the phase shifter module.

The phase shifter module 10 is formed in a stacked configuration comprising two main PCB(s) 13, each with an associated movable conductive component such as a wiper 16. The main PCB(s) 13 may be formed identically or modified to a specific electrical configuration by manipulating the various conductive traces thereon. As shown in FIGS. 2*a* and 2*b*, a representative main PCB having a trace side 19 and a backplane side 21 has an input 24 coupled to an input trace 27 on the trace side 19. The input trace 27 extends to a wiper junction 30 and a first transmission line 33 extending to a first output 36. The wiper junction 30 is formed proximate a PCB mounting hole 39 through which the wiper 16 is rotatably coupled to the main PCB 13 via a fastener 43 extending through the PCB mounting hole 39 and a corresponding wiper mounting hole 46.

A transmission line segment, for example a first arcuate trace 49 of the main PCB 13, also on the trace side 19, divides an electrical path between output trace(s) 51 leading to a second output 54 and a third output 57 depending upon the position of the wiper 16 along the first arcuate trace 49. Similarly, a second arcuate trace 60 divides a second electrical path between output trace(s) 51 leading to a fourth output 61 and a fifth output 62. Slot(s) 63 may be formed in the main PCB edge(s) 65 proximate the input 24 and first through fifth output(s) 36, 54, 57, 61, 62 operate as cable guides that partially support signal cables (not shown) connected with the phase shifter and increase the contact area for soldering between the backplane side 21 of the main PCB 13 and the outer conductor of each cable. Because the first and second arcuate trace(s) 49, 60 share a common arc center, the prior second wiper and associated common linkage components are eliminated and the overall surface area requirements for the main PCB(s) 13 significantly reduced.

Figure 3:
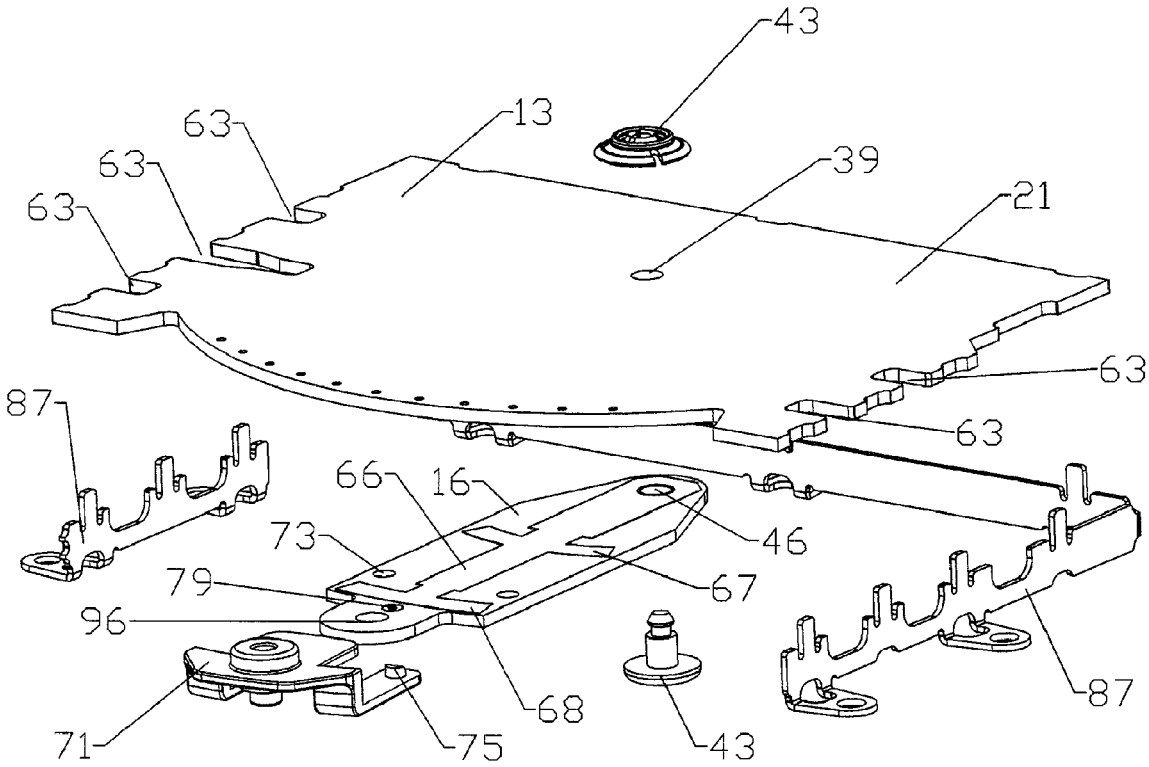
FIG. 3 is an exploded isometric schematic top/side view of a phase shifter printed circuit board and wiper according to FIG. 2.
Figure 4:
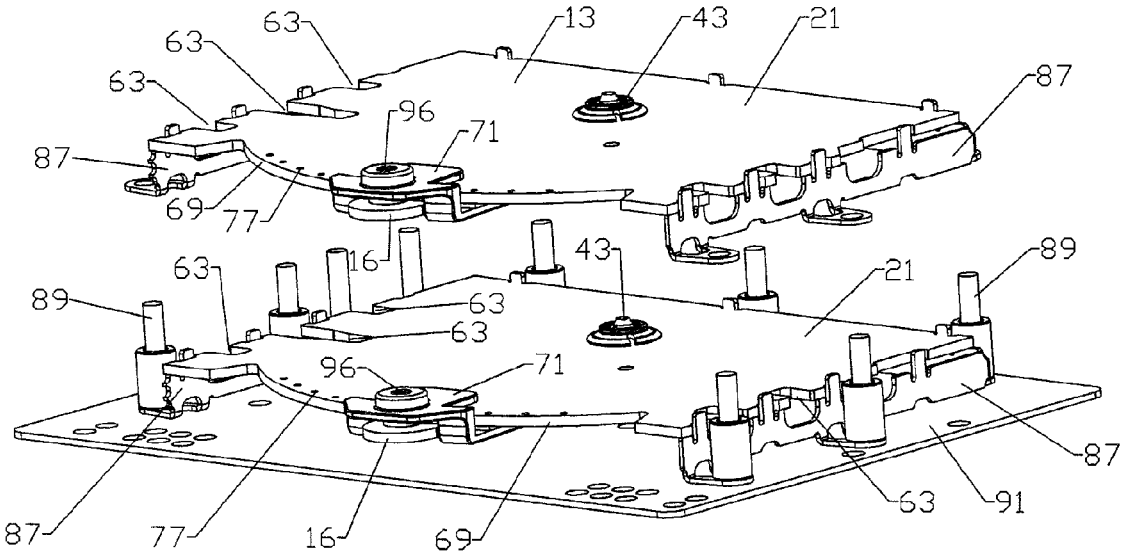
FIG. 4 is a partially exploded isometric schematic top/side view of a phase shifter module according to FIG. 1.
Figure 5:
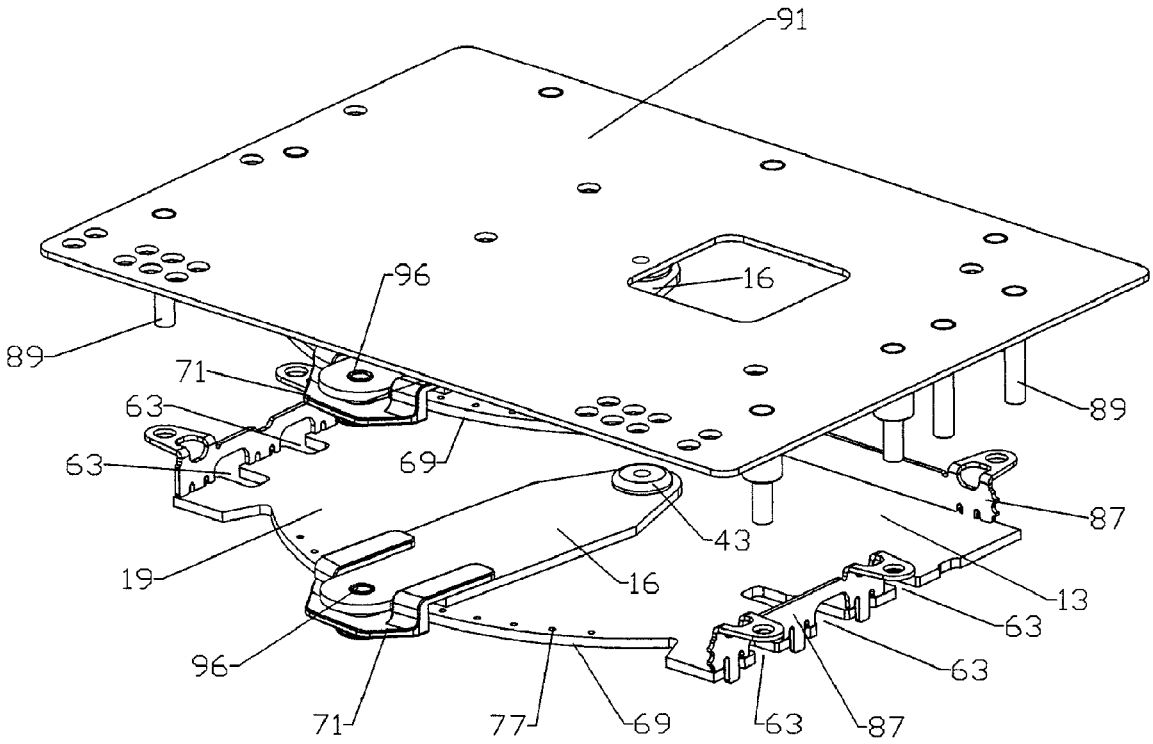
FIG. 5 is a partially exploded isometric schematic bottom/side view of a phase shifter module according to FIG. 1.
Figure 6:
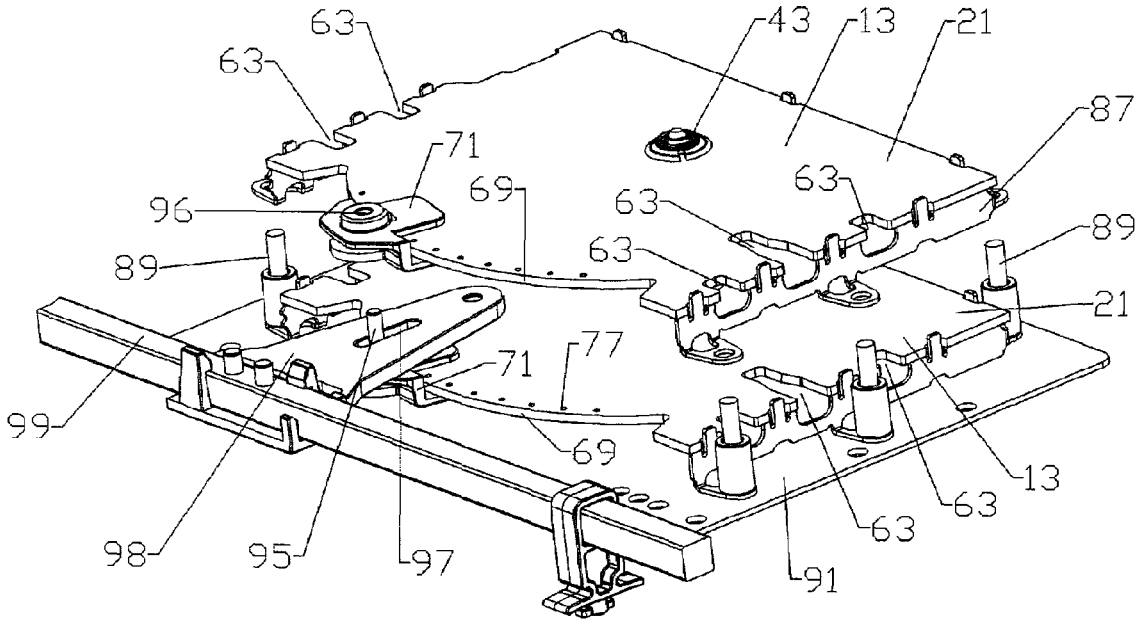
FIG. 6 is a partially exploded isometric schematic top/side view of a phase shifter module according to FIG. 1, including linkage plate and link arm.
Figure 7:
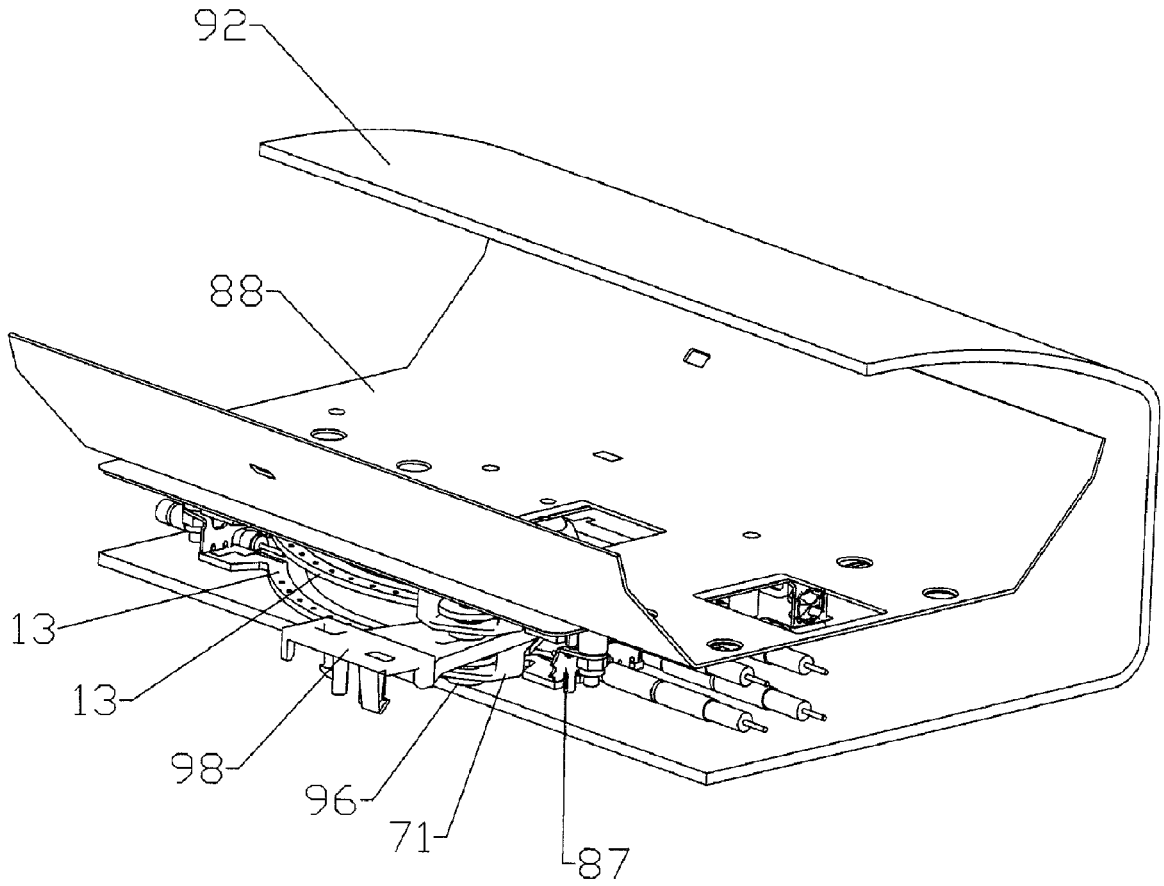
FIG. 7 is an isometric schematic partially cut-away view of a section of a panel array antenna.
Figure 8:
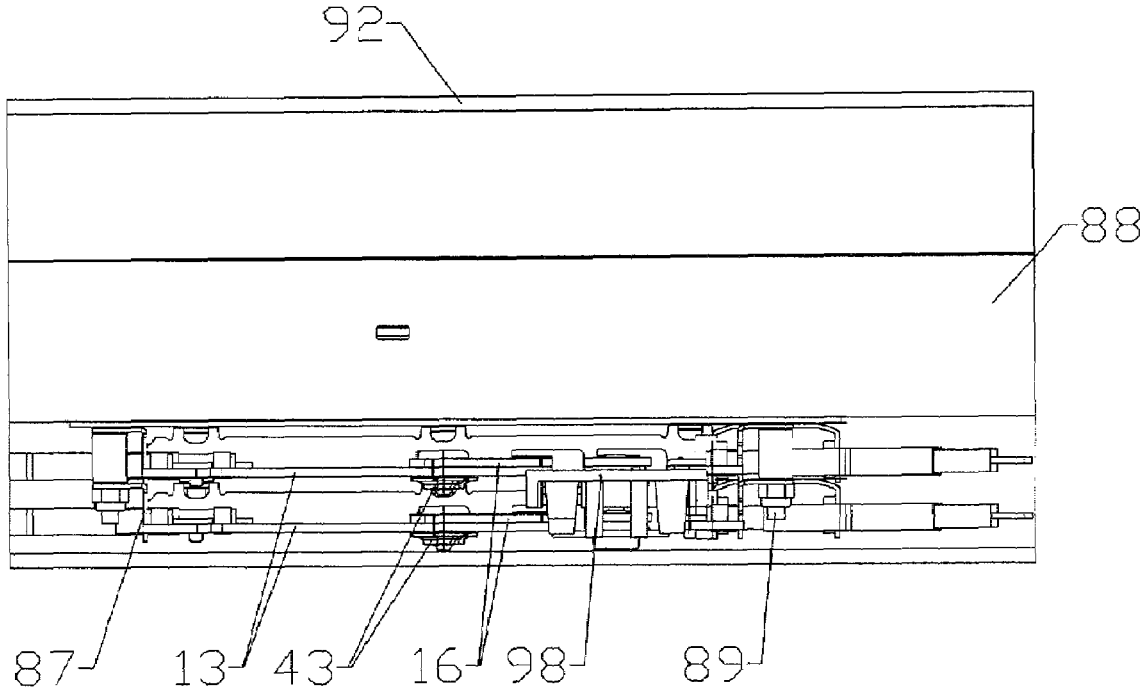
FIG. 8 is a side view of FIG. 7.
Figure 9:
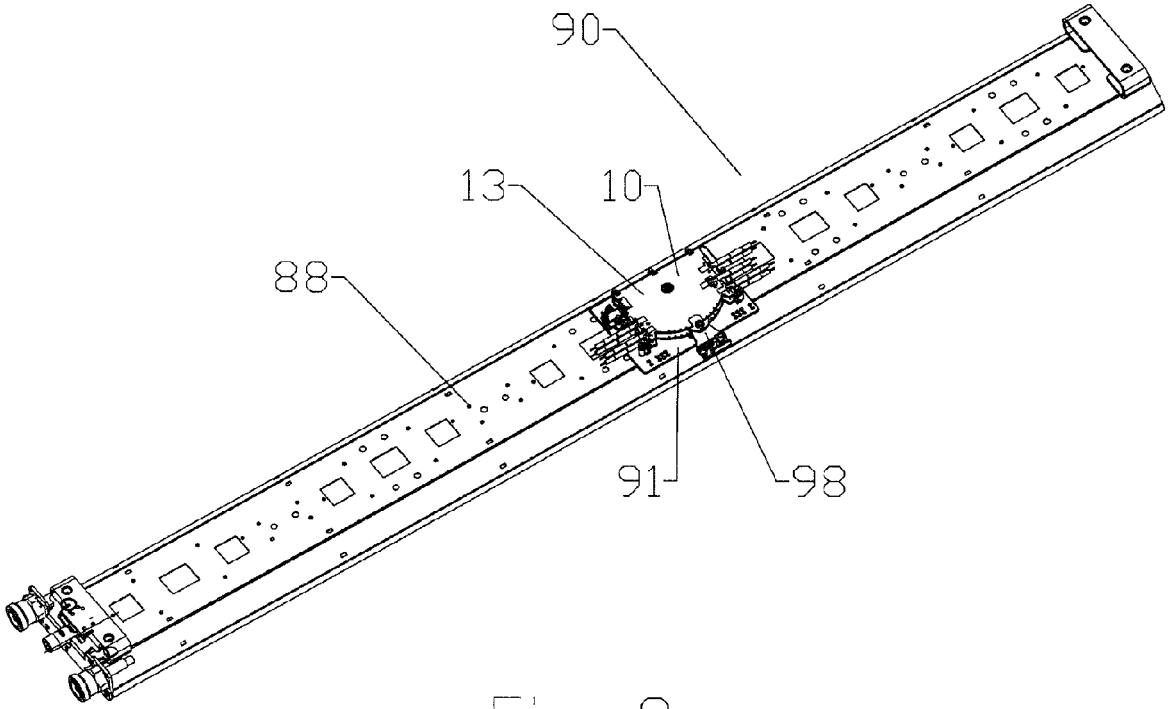
FIG. 9 is an isometric schematic view of the back side of a panel array antenna, with the radome, linkage, radiators and cabling omitted for clarity.
Figure 10:
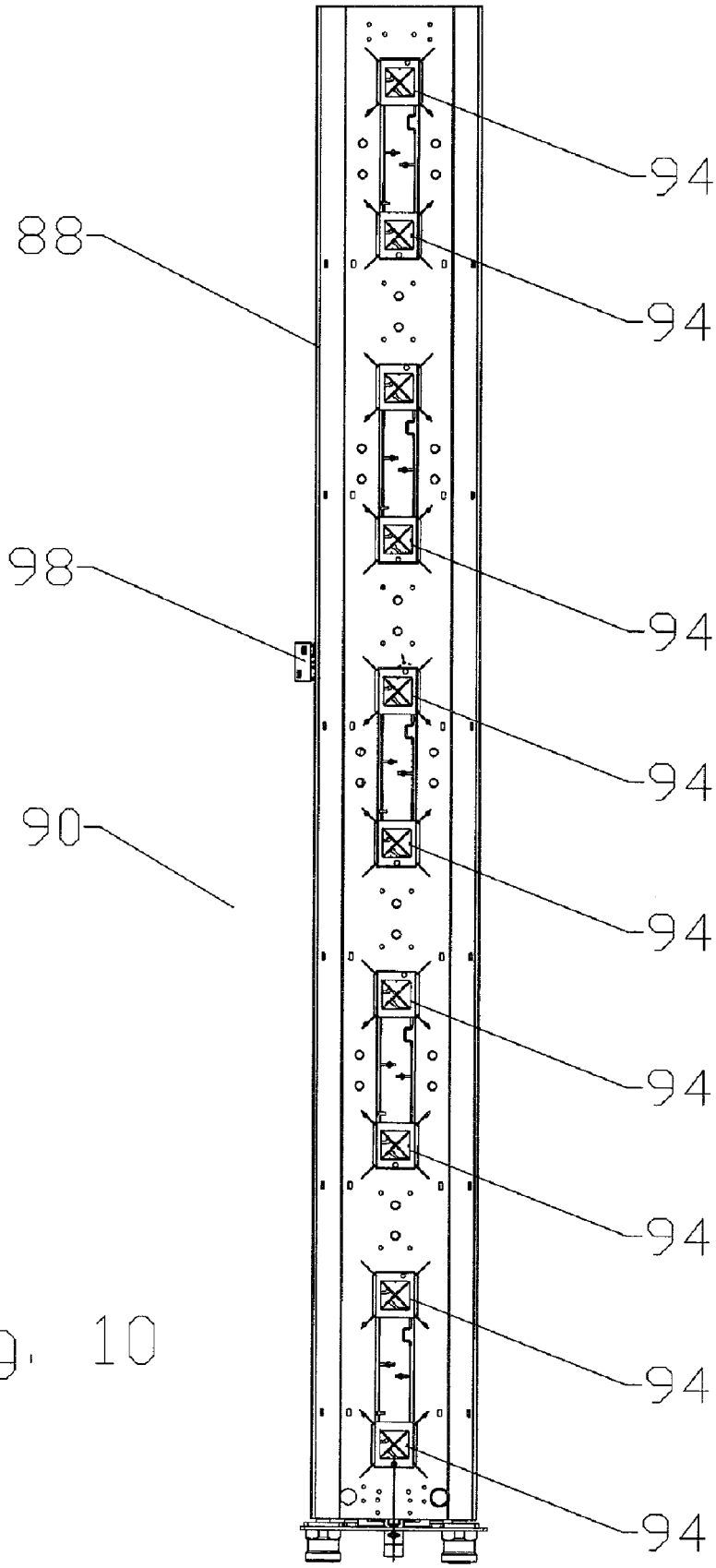
FIG. 10 is a front view of a panel array antenna, radome omitted for clarity.

As shown in FIG. 3, the wiper 16 is also formed from PCB substrate, with a linking trace 66 extending from the wiper mounting hole 46 to a first trace arc 67 and a second trace arc 68. The wiper 16 is mounted with the linking trace 66 facing the main PCB 13. A non-conductive surface coating upon the face of the main PCB 13 and or the wiper 16 insulates the wiper linking trace 66 and associated trace arcs 67, 68 from the main PCB 13 traces. Both the thickness of the non-conductive surface coating and the dielectric properties thereof may be adjusted to achieve a desired capacitive coupling between the linking trace 66 and associated main PCB 13 traces.

Narrowing and or widening of the thickness or height of each input trace(s) 27, various interconnecting transmission line(s) and the wiper linking trace 66 may be selected to operate as a power divider whereby a desired power distribution occurs between the input 24 and the first through fifth outputs 36, 54, 57, 61, 62. Further power division may also be incorporated between the second and third outputs 54, 57 and or between the fourth and fifth outputs 61, 62 by incorporating further relative thickness or height adjustments to the respective output trace(s) 51. Also, a preconfigured phase adjustment for a specific output may be applied by extending one or another of the output trace(s) 51 relative to the other(s).

Configuring the linking trace 66 to face the main PCB 13 according to the invention has several advantages. First, in a microstrip configuration it is well known that the majority of energy is confined to the area between the conductors. Since the linking trace 66 is between the first and second arcuate traces 49, 60 and common ground plane of the backplane side 21 on one side and the wiper 16 substrate on the other, only a small percentage of the energy travels through the wiper substrate. This makes the loss and dielectric constant parameters of the wiper 16 substrate unimportant, allowing low-cost high-strength standard materials such as epoxy glass PCB substrate to be used. To minimize IMD, the linking trace 66, first trace arc 67 and second trace arc 68 can be separated from the first and second arcuate traces 49, 60 by applying a non-conductive conformal coating upon either one or both of the first and second arcuate traces 49,60 and or the linking trace 66 of the wiper 16. This can be done very cost-effectively, for example, by using a material commonly employed in the PCB industry. An example material is soldermask or other conformal coating, which can be applied by silkscreening and then curing with UV light as the PCB(s) are fabricated. Thereby, the need for the assembly plant to add insulating tapes or shim layers while assembling the phase shifter module 10 is eliminated which are slow and costly to apply, are subject to damage, and are subject to high material costs.

Another example of a class of acceptable materials are organics such as Humiseal 1B73, available from the Humiseal Division of Chase Corp, Pittsburgh Pa., which evaporate when exposed to the heat of molten solder and can be applied inexpensively by dipping, spraying, or other liquid coating processes. The conformal coating may be a plastic material into which the wiper may be dipped or with which the wiper may be covered. In yet another implementation of the invention, the wiper may be metal with a conformal coating on the side facing the conductive arc or enveloping the wiper. In this novel use of a metal wiper, the structural benefits of the use of a metal wiper are exploited.

Once a standard substrate such as PCB rather than microwave-quality substrate is applied, it becomes cost effective to extend the wiper 16 substrate as necessary to integrate the linkage connector functionality. Another benefit of integrating the linkage functionality is that it allows maximum minimization of the phase shifter thickness. If the wiper 16 substrate were microwave-quality then additional layers would be needed for linkage elements or elements providing mechanical support. This configuration also improves upon airline embodiments where the tolerance stack of the airline spacers requires a larger ground-plane-to-airline spacing to be used (typically 0.13" versus 0.06" for substrates). In addition the radiation from an airline structure often requires the use of a stripline configuration in which there are two ground planes on either side of the airlines, again increasing the thickness and relative complexity of the resulting phase shifter structures.

The overall number of discrete components required and the end to end dimension of the phase shifter module may be minimized, for example, by forming an arcuate (about the wiper mounting hole) edge guide surface 69 on the main PCB 13. A, for example, "C", "M" or "W" shaped clip 71 may be used to hold each wiper 16 against its respective main PCB 13 as the clip 71 moves along the arcuate edge guide surface 69. Coupling hole(s) 73 formed in the wiper 16 and corresponding coupling protrusion(s) 75 of the clip 71 may be used to securely snap-on couple the clip 71 to the wiper 16 without requiring a separate fastener. A series of position hole(s) 77 proximate the arcuate edge guide surface 69 and a detent pin 79 on the wiper 16, adapted to key into each position hole 77 along the wiper 16 path, may be used to provide a snap-into-place detenting feedback to the desired linkage system, to positively indicate when each incremental step of wiper 16 travel has been reached.

Alternatively, as shown for example in FIG. 2*b*, an arcuate (about the mounting hole) guide slot 81 may be applied to the main PCB 13 as a guide means for the distal end of the wiper 16. A guide fastener 83 between the guide slot 81 and a guide hole 85 formed in the wiper 16 may be used to fix the wiper 16 in a desired position along the first and second arcuate trace(s) 49, 60 and or ensure that the distal end of the wiper 16 is biased towards the main PCB 13 so that the level of capacitive coupling is constant.

Stand-off(s) 87 may be applied to provide a secure mounting point for each main PCB 13 as well as to partially shield the phase shifter module 1 0 from electrical interference/radiation. As shown in FIGS. 4-10, multiple phase shifter module(s) 10 may be stacked one upon the other via the standoff(s) 87, for example upon post(s) 89 fixed to a mounting plate 91 or the like. While the present phase shifter module 10 embodiment demonstrates a two input and ten output configuration useful for a dual polarized multiple radiator antenna array, additional main PCB(s) 13 may be similarly stacked one upon the other as needed to achieve other configurations.

In use, as shown for example by FIGS. 7-10, the phase shifter module(s) 10 may be incorporated into a panel antenna 90 as part of a feed network connecting an input signal to an array of radiator(s) 94. The phase shifter module(s) 10 may be mounted to the backplane or shield 88 and a surrounding radome 92 environmentally seals the panel antenna 90.

Because the main PCB(s) 13 are stacked one upon the other, preferably oriented with their wiper mounting hole(s) 46 co-axial, a simplified linkage arrangement 93 that operates each wiper 16 in unison may be applied. As shown, for example, in FIG. 6, the linkage arrangement 93 may comprise a linkage pin 95 extending between linkage hole(s) 96 proximate a distal end of each wiper 16 and or clip 71 to link the wiper(s) 16 together and also engage a linkage slot 97 formed in the link plate 98 of a link arm 99 movable to position each wiper as desired along its range of movement.

Alternatively, as shown for example by FIG. 2*b*, the wiper 16 may be extended and the linkage hole 96 replaced with a linkage slot 97 formed in the distal end of the wiper 16, eliminating the need for the link plate 98.

The embodiment(s) shown in FIGS. 1-10 demonstrate configurations where the trace side(s) 19 of each main PCB 13 are facing the mounting surface. Alternatively, pairs of main PCB 13 may be arranged backplane side 21 to backplane side 21, further simplifying the fastener 43 and linkage arrangement(s) 93.

The present invention brings to the art a cost effective phase shifter module 10 with minimal space requirements. Providing the printed circuit boards with dual arcuate traces having a common arc center reduces PCB substrate materials requirements, eliminates two wiper assemblies and simplifies the mechanical linkage. Adapting the wiper(s) to have the linking trace thereon facing the main PCB eliminates the prior requirement for forming the wiper using a specialized, expensive, substrate with particular dielectric qualities. The reduced size of the phase shifter module, overall, enables a more centralized positioning of the phase shifter upon an antenna back plane allowing shortening of the worst case length to which each of the signal cables is dimensioned for extending to each radiator cluster. Because the linkage requirements are simplified, the overall thickness or height of the antenna is not significantly increased, even though the printed circuit boards are stacked upon each other.

Other variations and modifications of the described invention implementations will be described. For example, with the wiper conductive component on the bottom of the wiper facing the conductive arc and phase shifter backplane, air may be used as the dielectric material. Air is a very inexpensive and satisfactory dielectric, however, shims or other techniques will be required to assure a precise and uniform spacing of the wiper conductor and conductive arc and the thickness of the phase shifter will be greater than is the case if a dielectric is employed having a higher dielectric constant. Further, the conductive arc could be configured as an airline, but at a sacrifice of compactness in the height of the phase shifter and the embodying antenna. Whereas in the preferred executions of the invention, a pivoted wiper traversing a circular conductive arc transmission line is employed, one skilled in the art will understand that the principles of the invention can be utilized in arrangements where the wiper is moved linearly, or along a curved path other than a segment of a circle.

One skilled in the art will recognize that the present invention is not limited to use mounted upon base station antennas as described in the exemplary embodiment(s) presented. Phase shifters may be applied in numerous other applications where the manufacturing efficiencies and overall size reduction realized via the present invention may be appreciated.

Table of Parts

| | |
|---|---|
| 10 | phase shifter module |
| 13 | main printed circuit board (PCB) |
| 16 | wiper |
| 19 | trace side |
| 21 | backplane side |
| 24 | input |
| 27 | input trace |
| 30 | wiper junction |
| 33 | first transmission line |
| 36 | first output |
| 39 | PCB mounting hole |
| 43 | fastener |
| 46 | wiper mounting hole |
| 49 | first arcuate trace |
| 51 | output trace |
| 54 | second output |
| 57 | third output |
| 60 | second arcuate trace |
| 61 | fourth output |
| 62 | fifth output |
| 63 | slot |
| 65 | main PCB edge |
| 66 | linking trace |
| 67 | first arc trace |
| 68 | second arc trace |
| 69 | arcuate edge guide surface |
| 71 | clip |
| 73 | coupling hole |
| 75 | coupling protrusions |
| 77 | position hole |
| 79 | detent pin |
| 81 | arcuate guide slot |
| 83 | guide fastener |
| 85 | guide hole |
| 87 | stand-off |
| 88 | shield |
| 89 | post |
| 90 | panel antenna |
| 91 | mounting plate |
| 92 | radome |
| 93 | linkage arrangement |
| 94 | radiator |
| 95 | linkage pin |
| 96 | linkage hole |
| 97 | linkage slot |
| 98 | link plate |
| 99 | link arm |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A variable phase shifter module, comprising:

a first main PCB having an input trace coupled to a first wiper junction;

a first arcuate trace extending between a first output trace and a second output trace on the first main PCB, the first arcuate trace having an arc center proximate the first wiper junction;

a first wiper PCB having a linking trace thereon; the first wiper PCB rotatably coupled to the first main PCB proximate the first wiper junction with the linking trace facing the first main PCB;

the linking trace coupling the first wiper junction with the first arcuate trace; and an arcuate edge guide surface formed in the first main PCB having an arc center proximate the first wiper junction; and a clip coupled to the first wiper PCB to bias the first wiper PCB against the first main PCB about the arcuate edge guide surface.

2. The apparatus of claim 1, further including a second arcuate trace extending between a third output trace and a fourth output trace; the second arcuate trace having an arc center proximate the first wiper junction.

3. The apparatus of claim 1, further including a fifth output trace coupled to the first wiper junction.

4. The apparatus of claim 1, wherein the first output trace and second output trace have a width and length selected to provide a desired power division and pre-set phase shift differential.

5. The apparatus of claim 1, wherein one of the first main PCB, the first wiper PCB and both of the first main PCB and the first wiper PCB have a dielectric coating.

6. The apparatus of claim 1, wherein the wiper PCB has an epoxy glass substrate.

7. The apparatus of claim 1, wherein the wiper PCB has a linkage slot formed in a distal end.

8. The apparatus of claim 5 wherein said dielectric coating is composed of soldermask or an organic compound.

9. A variable phase shifter module, comprising:

a first main PCB having an input trace coupled to a first wiper junction;

a first arcuate trace extending between a first output trace and a second output trace on the first main PCB, the first arcuate trace having an arc center proximate the first wiper junction;

a first wiper PCB having a linking trace thereon; the first wiper PCB rotatably coupled to the first main PCB proximate the first wiper junction with the linking trace facing the first main PCB;

the linking trace coupling the first wiper junction with the first arcuate trace; and an arcuate guide slot formed in the first main PCB having an arc center proximate the first wiper junction; and a fastener extending through the guide slot and a guide hole formed in the first wiper PCB to bias the first wiper PCB against the first main PCB.

10. A variable phase shifter module, comprising:

a first main PCB having an input trace coupled to a first wiper junction;

a first arcuate trace extending between a first output trace and a second output trace on the first main PCB, the first arcuate trace having an arc center proximate the first wiper junction;

a first wiper PCB having a linking trace thereon; the first wiper PCB rotatably coupled to the first main PCB proximate the first wiper junction with the linking trace facing the first main PCB;

the linking trace coupling the first wiper junction with the first arcuate trace; and a second main PCB with a second wiper PCB coupled proximate a second wiper junction;

the second wiper pcb rotatably coupled to the second main PCB proximate the second wiper junction;

the first wiper junction and the second wiper junction aligned in a spaced apart coaxial orientation;

the first wiper PCB and the second wiper PCB coupled together by a linkage pin at a spaced apart location from the first wiper junction joining a first clip, coupled to the first wiper to bias the first wiper PCB against the first main PCB, to a second clip, coupled to the second wiper to bias the second wiper PCB against the second main PCB.

11. The apparatus of claim 10, further including a base plate to which the first PCB and second PCB are coupled; a trace side of the first PCB and of the second PCB each facing the baseplate.

12. The apparatus of claim 10, further including a base plate to which the first PCB and second PCB are coupled; a trace side of the first PCB and of the second PCB arranged facing away from each other.

13. The apparatus of claim 10, further including an arcuate edge guide surface formed in the first main PCB having an arc center proximate the first wiper junction; and a clip coupled to the wiper to bias the wiper against the first main PCB, about the arcuate edge guide surface.

14. A variable phase shifter module, comprising:

a first main PCB having an input trace coupled to a first wiper junction;

a first arcuate trace extending between a first output trace and a second output trace on the first main PCB, the first arcuate trace having an arc center proximate the first wiper junction;

a second arcuate trace extending between a third output trace and a fourth output trace; the second arcuate trace having an arc center proximate the first wiper junction; a first wiper PCB having a linking trace thereon; the first wiper PCB rotatably coupled to the first main PCB proximate the first wiper junction with the linking trace facing the first main PCB; and an arcuate edge guide surface formed in the first main PCB having an arc center proximate the first wiper junction; and a clip coupled to the wiper to bias the first wiper PCB against the first main PCB, about the arcuate edge guide surface;

the linking trace coupling the first wiper junction with the first arcuate trace and the second arcuate trace.

15. The apparatus of claim 14, further including a second main PCB with a second wiper PCB coupled proximate a second wiper junction;

the wiper rotatably coupled to the second printed circuit board proximate the second wiper junction;

the first wiper PCB and the second wiper PCB coupled together;

the first wiper junction and the second wiper junction aligned in a spaced apart coaxial orientation.

16. The apparatus of claim 15, further including a base plate to which the first PCB and second PCB are coupled; a trace side of the first PCB and of the second PCB each facing the baseplate.

17. The apparatus of claim 15, further including a base plate to which the first PCB and second PCB are coupled; a trace side of the first PCB and of the second PCB arranged facing away from each other.

18. The apparatus of claim 14, further including a linkage slot formed in the distal end of the first wiper PCB.

19. The apparatus of claim 14 wherein the linking trace is located on a side of the first wiper PCB facing the first arcuate trace.

20. The apparatus of claim 19 wherein said linking trace has a coating composed of dielectric material.

21. The apparatus of claim 20 wherein said dielectric coating comprises soldermask or organic material.

* * * * *